United States Patent [19]

Hickey

[11] Patent Number: 4,573,032

[45] Date of Patent: Feb. 25, 1986

[54] INDUCTIVELY COMPENSATED TRIGGER CIRCUIT FOR A CHEMICALLY AUGMENTED FUSE

[75] Inventor: John S. Hickey, Burnt Hills, N.Y.

[73] Assignee: General Electric Company, Schenectady, N.Y.

[21] Appl. No.: 568,330

[22] Filed: Jan. 5, 1984

[51] Int. Cl.[4] ..... H01H 85/04; H01H 37/76

[52] U.S. Cl. ..... 337/162; 337/401

[58] Field of Search ..... 337/401, 293, 162, 161

[56] References Cited

U.S. PATENT DOCUMENTS

| | | | |
|---|---|---|---|
| 3,705,373 | 12/1972 | Cameron | 337/401 |
| 3,958,206 | 5/1976 | Klint | 337/401 |
| 4,176,385 | 11/1979 | Dethlefsen | 337/401 |
| 4,486,734 | 12/1984 | Leach | 337/162 |
| 4,489,301 | 12/1984 | Johnson et al. | 337/401 |

*Primary Examiner*—Harold Broome

*Attorney, Agent, or Firm*—Lawrence D. Cutter; James C. Davis, Jr.; Marvin Snyder

[57] ABSTRACT

An inductively compensated trigger conductor for use in a chemically augmented fuse, of the type in which current flow through the fuse generates a magnetic field, employs at least one loop of electrically conductive material to inductively couple the trigger conductor to the magnetic field of the fuse. This inductive coupling increases the electrical inductance of the trigger circuit, and allows the fuse to be constructed so that the current division between the fuse conductor and the trigger conductor is constantly proportional, or at least more nearly so. When employed in a fuse which also includes a non-magnetic fuse support structure, a trigger device, and a means for chemically augmenting the separation of the fuse conductor into more than one segment during current interruption, the trigger circuit of this invention provides triggering action which is responsive only to the level of current flowing through the fuse, and not to a high rate of rise of current.

13 Claims, 4 Drawing Figures

INDUCTIVELY COMPENSATED TRIGGER CIRCUIT FOR A CHEMICALLY AUGMENTED FUSE

BACKGROUND OF THE INVENTION

This invention relates to trigger circuits for chemically augmented fuses of the type in which current flow through the fuse produces a magnetic field. More particularly, it relates to inductively coupling the trigger circuit to the magnetic field of the fuse to increase the inductance of the trigger circuit.

It is now known in the electrical fuse arts to use chemical augmentation to separate the fuse elements during current interruption. Typically, this augmentation takes the form of melting the fuse conductor in a number of locations along its length. The chemical augmentation may also be by way of mechanical separation rather than melting, with the means for mechanically cutting the fuse conductor propelled by a pyrotechnic chemical charge. For all of these types of fuses, the chemical augmentation action is initiated by a trigger circuit electrically connected in parallel with the fuse conductor. There are a number of such chemically augmented fuse designs known in the electrical fuse arts. For example, chemically augmented fuses are apparently described in U.S. Pat. No. 3,958,206, issued May 18, 1976 to R.V. Klint, U.S. Pat. No. 4,176,385 issued Nov. 27, 1979 to Dethlefsen, and U.S. Pat. No. 3,705,373 issued Dec. 5, 1972 to F.L. Cameron. Conventional chemically augmented fuses of the type which are useful in the present invention typically include at least one main fusible conductive element and an auxiliary conductive element electrically connected to the main element at at least two spaced-apart points along the length of the main element. The auxiliary element is made of a high resistivity material, so that current normally flows through the main fusible element. When, in response to an overcurrent, the main fusible element melts in the conventional manner at a location between the two points where the auxiliary element is connected, current is diverted into the auxiliary element. The auxiliary element comprises a trigger circuit and an exothermic material placed adjacent or touching the main fusible element. The trigger circuit and exothermic material may be combined, so that the auxiliary element is formed from exothermic material, or they may be separate, with the trigger circuit connected to the exothermic material so that current flow through the trigger circuit initiates a chemical reaction in the exothermic material. In either case, current flow through the trigger circuit, above a predetermined level, causes an exothermic reaction which heats the main fusible element and causes it to melt at one or more locations in addition to the first location which melted in response to the overcurrent.

It is often desirable that the trigger circuit used to initiate the chemically augmented operation of the fuse act only in response to a high current through the fuse, and not be triggered by a high rate of rise of current rather than a high level of current. In theory, if fuse and trigger conductors could be made having no inductance, the fuse voltage would essentially consist of only a resistive component, and the desired action of triggering only on a high current level could be achieved quite easily. In practice, however, the fuse conductor is typically helically wound around a cylindrical support structure, in order to increase the length of the fuse conductor for a given fuse size and thereby increase the fuse voltage capability. This winding pattern results in a substantial inductive component to the fuse impedance. Furthermore, in many fuses, multiple fuse conductors, all helically wound, are used to increase the current carrying capacity of the fuse.

The significance of this inductive component lies in the fact that the division of current between the main fuse conductor and the trigger conductor is crucial to the proper operation of the fuse. Because of the inductive voltage associated with this inductive component of the fuse conductor impedance, a high rate of rise of the level of the current through the fuse can result in a high voltage between the terminals of the fuse, even when the level of the current stays below the threshold current at which the fuse is designed to operate. With the trigger circuit electrically connected in parallel with the fuse conductor, this same fuse voltage is impressed on the trigger circuit. If the inductance of the trigger circuit is too low, the portion of the fuse voltage that is applied to the resistive component of the trigger circuit will be high enough to produce current flow through the trigger circuit in excess of the trigger level. Thus, unless the inductances of the fuse conductor and the trigger circuit are properly proportioned, the fuse may trip prematurely on a high rate of rise of current rather than just on high current.

Moreover, it is not practical to provide the proper proportioning by simply increasing the inductance of the trigger circuit. Because of the proportionalities involved, the trigger circuit inductance required to achieve the proper balance of inductance between the fuse conductor and the trigger circuit is quite large and not readily attainable for practical trigger conductors.

Accordingly, it is an object of the present invention to provide a trigger conductor for use in chemically augmented fuses that results in a constantly proportional division of current between the trigger circuit and the fuse conductor.

It is a further object of this invention to provide a trigger circuit for use in chemically augmented fuses that increases the inductance of the trigger circuit, without increasing the inductance of the trigger conductor.

It is also an object of the present invention to provide a chemically augmented fuse that is triggered only by a high current level, and not by a high rate of rise of current.

SUMMARY OF THE INVENTION

In accordance with one embodiment of the present invention, a trigger conductor for use in an inductively compensated trigger circuit for a chemically augmented fuse, of the type in which current flow through the main current carrying fuse conductor generates a magnetic field, comprises at least one loop of electrically conductive material disposed so as to be inductively coupled to the magnetic field of the fuse, so that the effective inductance of the trigger conductor is increased by the inductive coupling. In another embodiment of the invention, a trigger circuit for such a fuse includes the trigger conductor described above, electrically connected in parallel with the main current carrying fuse conductor, and may and further comprise a trigger device electrically connected to the trigger conductor, for initiating an exothermic reaction in the chemically augmented fuse in response to a predetermined level of current flow through the trigger circuit. In yet another embodiment of the present invention, a chemically augmented fuse having an inductively compensated trigger circuit comprises a non-magnetic fuse support structure, around which is wound at least one fuse conductor, so that current flow through the fuse conductor generates a magnetic field. A trigger conductor is electrically connected in parallel with the fuse conductor and contains at least one loop of electrically conductive material inductively coupled to the magnetic field of the fuse, so that the inductance of the trigger conductor is increased by the inductive coupling. Electrically connected to the trigger conductor is a trigger device for initiating the chemically augmented operation of the fuse, in response to a predetermined level of current flow through the trigger conductor. Responsive to the action of the trigger device is a means for chemically augmenting the separation of the fuse conductor into more than one segment during current interruption.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE INVENTION

Figure 1:
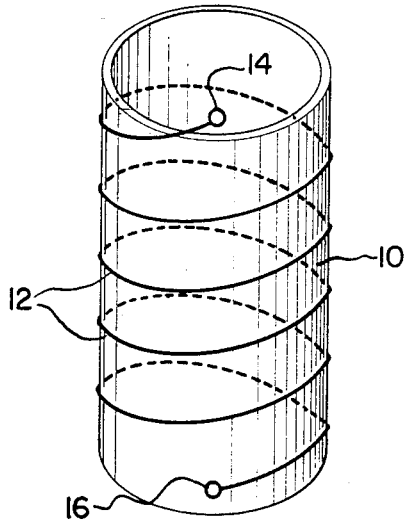
FIG. 1 is a perspective view showing a fuse support structure around which a fuse conductor is helically wound, in accordance with one embodiment of the present invention.

FIG. 1 illustrates the type of fuse conductor winding employed in many chemically augmented fuses. The fuse conductor for such fuses typically comprises fuse conductor windings 12 helically wound around the outside of fuse support structure 10. The fuse is electrically connected to the circuit to be protected by means of fuse terminals 14 and 16. The fuse conductor winding pattern shown in FIG. 1 results in a substantial inductance component to the electrical impedance between terminals 14 and 16. For the sake of clarity, only one fuse conductor is shown in FIG. 1. However, in many electrical fuses, such as, for example, power line fuses, a plurality of such conductors are employed, all wound around support structure 10 and electrically connected in parallel with each other and with fuse conductor windings 12 shown in FIG. 1. Multiple fuse conductors are used to increase the current carrying capacity of the fuse.

For many of the types of fuses shown in FIG. 1, separation of fuse conductor 12 into more than one element during current interruption by the fuse is chemically augmented by an exothermic material disposed so that the exothermic reaction of the material melts fuse conductor 12 at a number of locations along its length. Examples of such chemical augmentation of the fuse operation are described in the above-referenced U.S. Patent Nos. 3,958,206, 4,176,385, and 3,705,373. Typically, an exothermic material is placed so that it is adjacent to or touching fuse conductor 12 at a number of locations along the length of conductor 12. A trigger circuit is connected between terminals 14 and 16 so that the trigger circuit is electrically in parallel with fuse conductor 12. The trigger circuit may consist entirely of a conductor formed from high resistivity exothermic material, placed adjacent to conductor 12 in the manner described above. Alternatively, the trigger circuit may include a trigger conductor formed of non-exothermic material, electrically connected in series with one or more conductors of high resistivity exothermic material placed adjacent fuse conductor 12. For this embodiment, the trigger conductor is connected to one of terminals 14 and 16, and the exothermic conductor is connected to the other of terminals 14 and 16. The trigger circuit may also comprise a non-exothermic trigger conductor electrically connected to a trigger device, with the trigger device acting to initiate a chemical reaction in an exothermic material placed adjacent fuse conductor 12, in response to a predetermined level of current flow in the trigger conductor. For example, the trigger conductor may be electrically connected between terminals 14 and 16, and a separate conductor formed of exothermic material may be placed adjacent to fuse conductor 12 at a number of locations along the length of conductor 12. The trigger device may comprise a current sensing circuit electrically connected to the trigger conductor, so as to sense the current flowing therethrough. For such an embodiment, the trigger device is electrically connected to the conductor formed from exothermic material, and includes means for passing a high level of current through the exothermic conductor when a predetermined level of current flow through the trigger conductor is sensed. For all of these trigger circuits, the electrical resistance of the circuit between terminals 14 and 16 is much higher than the resistance of fuse conductor 12 between terminals 14 and 16, so that current normally flows through fuse conductor 12. When the current through conductor 12 exceeds its specified rating level, conductor 12 melts at one or more locations between terminals 14 and 16, in the manner conventionally employed in the electrical fuse arts. This melting of fuse conductor 12, in turn, increases the electrical resistance of conductor 12 between terminals 14 and 16 to a high enough level that current is diverted into the trigger circuit. When the current level in the trigger circuit reaches a predetermined level, a chemical reaction is initiated in the exothermic material, for example, in accordance with one of the embodiments of the trigger circuit described above. This exothermic reaction, in turn, causes melting of fuse conductor 12 in a number of locations along its length, thereby separating fuse conductor 12 into a number of segments. For the first two embodiments of the trigger circuit described above, it is readily apparent that the chemical reaction in the exothermic conductor also acts to interrupt the electrical conductivity of the exothermic conductor. Hence, current flow through the trigger circuit is also interrupted, thereby completing the current interruption function of the fuse. In order to achieve the same result when the third embodiment of the trigger circuit described above is employed, an exothermic conductor should also be placed adjacent to the trigger conductor, with this exothermic conductor electrically connected to the trigger device so that a high level of current is passed through this exothermic conductor, in response to the predetermined level of current in the trigger conductor which is used to initiate the exothermic melting of fuse conductor 12. Separate exothermic conductors may be employed to cause melting of fuse conductor 12 and the trigger conductor, or the same exothermic conductor may be utilized for both.

Figure 2:
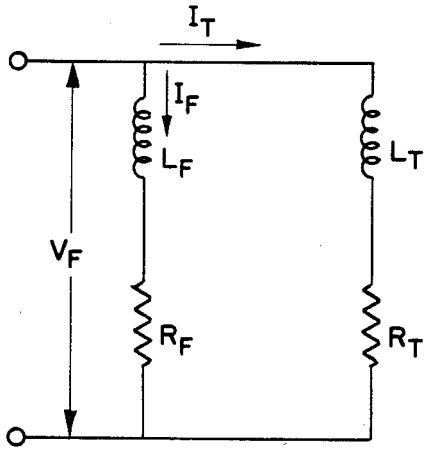
FIG. 2 depicts the equivalent circuit resulting from connecting a trigger conductor electrically in parallel with the fuse conductor shown in FIG. 1.

When a conventional type of trigger conductor is connected to the fuse conductor shown in FIG. 1 directly between terminals 14 and 16 and electrically in parallel with fuse conductor windings 12, the electrical equivalent of the resulting fuse can be drawn as the circuit shown in FIG. 2. The total current through the fuse is the sum of the current through the fuse conductor, $I_F$, and the current through the trigger conductor, $I_T$. For proper operation of the fuse, the current through the fuse conductor should be much larger than the current through the trigger conductor, so that $I_F >> I_T$. The voltage across the fuse conductor, $V_F$, between terminals 14 and 16, consists of a resistive component due to the fuse conductor current, $I_F$, flowing through the fuse conductor resistance, $R_F$, and an inductive component due to the rate of change of fuse conductor current, $dI_F/dt$, through the fuse conductor inductance, $L_F$. Thus, the fuse voltage can be written as $$V_F = R_F I_F + L_F(dI_F/dt). \quad (1)$$

This same fuse voltage is impressed across the trigger conductor, which similarly consists of a resistive component and an inductive component. Therefore, the fuse voltage may also be written as $$V_F = R_T I_T + L_T(dI_T/dt). \quad (2)$$

Combining Equations (1) and (2), $$R_F I_F + L_F(dI_F/dt) = R_T I_T + L_T(dI_T/dt). \quad (3)$$

For steady state conditions, where the rate of change is zero for both the fuse conductor current and the trigger conductor current, Equation (3) becomes $$R_F I_F = R_T I_T, \quad (4)$$

which can be rewritten as $$I_F/I_T = R_T/R_F. \quad (5)$$

For the requirement for proper fuse operation that $I_F$ be much larger than $I_T$, it can be seen from Equation (5) that $R_T$ must be much larger than $R_F$. For conditions where the rate of change of current is not zero, in order to maintain the constantly proportional division of current between the fuse conductor and the trigger conductor indicated by Equation (5), it is seen from Equation (3) that the inductive component of the fuse conductor voltage must equal the inductive component of the trigger conductor voltage, so that $$L_F(dI_F/dt) = L_T(dI_T/dt). \quad (6)$$

To satisfy Equation (6), the time constant of the fuse conductor must equal the time constant of the trigger conductor. For this condition, $$L_F/R_F = L_T/R_T, \quad (7)$$

which can be rewritten as $$L_T/L_F = R_T/R_F. \quad (8)$$

Since, as noted above, $R_T$ is much larger than $R_F$, it can be seen from Equation (8) that $L_T$ must be much larger than $L_F$. However, for a trigger conductor connected directly between the terminals of the fuse conductor, such a large trigger inductance is difficult, if not impossible, to achieve in practical fuses.

The present invention uses mutual inductance between the fuse conductor and the trigger conductor to increase the inductance of the trigger conductor. Current flow through fuse conductor windings 12, as shown in FIG. 1, creates a magnetic field having field lines substantially parallel to the direction of the longitudinal axis of cylindrical fuse support structure 10. If the trigger conductor contains at least one loop wound in a manner similar to that of fuse conductor windings 12, these magnetic field lines will create a mutual inductance between such a trigger conductor loop and the fuse conductor windings. If the trigger conductor loop is wound in the proper direction, this mutual inductance serves to increase the effective inductance of the trigger conductor. In accordance with the present invention, a trigger conductor which takes advantage of this principle comprises at least one loop of electrically conductive material disposed so as to be inductively coupled to the magnetic field of the fuse, so that the inductance of the trigger conductor is increased by the inductive coupling.

Figure 3:
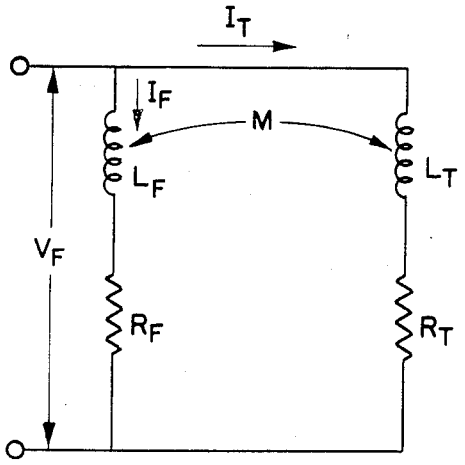
FIG. 3 depicts the equivalent circuit resulting from connecting a trigger conductor embodied by the present invention electrically in parallel with the fuse conductor shown in FIG. 1.

When a trigger conductor embodied by the present invention is electrically connected in parallel with the fuse conductor shown in FIG. 1, the electrical equivalent of the resulting fuse can be drawn as the circuit depicted in FIG. 3. For this circuit, the voltage across the fuse conductor includes an additional inductive component due to the mutual inductance created by current through the trigger conductor, and the voltage across the trigger conductor includes a similar inductive component due to the mutual inductance created by current through the fuse conductor. The fuse voltage, $V_F$, for this circuit can be written as $$V_F = R_F I_F + L_F(dI_F/dt) + M(dI_T dt) = R_T I_T + L_T(dI_T/dt) + M(dI_F/dt), \quad (9)$$

which can be rewritten as $$R_F I_F + (L_F - M)(dI_F/dt) = R_T I_T + (L_T - M)(dI_T/dt). \quad (10)$$

For the constantly proportional current division indicated by Equation (5), Equation (10) is satisfied when $$(L_F - M)(dI_F/dt) = (L_T - M)(dI_T/dt). \quad (11)$$

The condition of Equation (11) requires that the time constants for the fuse conductor and the trigger conductor be equal, so that $$(L_F - M)/R_F = (L_T - M)/R_T, \quad (12)$$

which can be rewritten as $$M = (R_T L_F - R_F L_T)/(R_T - R_F). \quad (13)$$

With the mutual inductance written as $$M=K\sqrt{L_F L_T} \quad (14)$$

substitution into Equation (13) and solving for K results in $$K=(R_T L_F - R_F L_T)/\sqrt{L_F L_T}(R_T - R_F). \quad (15)$$

When the inductive coupling between the trigger conductor and the fuse conductor is properly chosen, so that Equation (15) is satisfied, the current division between the trigger conductor and the fuse conductor is constantly proportional. As an example, and not by way of limitation, if $R_T=100R_F$ and $L_T=10L_F$, then $K=0.29$. For practical fuses, values of K less than about 0.5 are quite easily obtained. With the number of loops of the trigger conductor chosen to achieve the proper mutual inductance, the chemically augmented operation of the fuse will be triggered only by a high level of current, and not by a high rate of rise of current.

Figure 4:
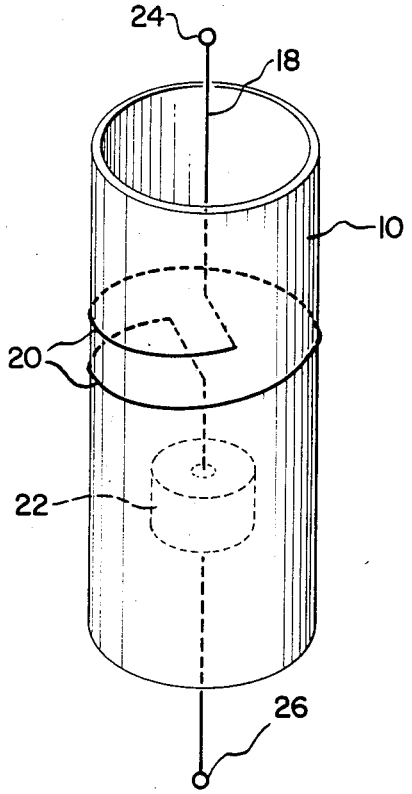
FIG. 4 is a perspective view of a fuse support structure and trigger circuit, in accordance with another embodiment of the present invention.

In accordance with the present invention, one embodiment of a trigger conductor which provides the equivalent circuit of FIG. 3 is shown in FIG. 4. Trigger conductor 18 contains at least one loop of electrically conductive material 20 inductively coupled to the magnetic field produced by current flowing through the fuse conductor (not shown in FIG. 4). Trigger conductor 18 is electrically connected in parallel with the fuse conductor by means of trigger conductor terminals 24 and 26. In some applications, it may be convenient to form trigger conductor terminals 24 and 26 as integral parts of fuse conductor terminals 14 and 16, respectively. Trigger conductor loops 20 are configured so that the inductive coupling between the trigger conductor and the fuse conductor results in increased electrical inductance between terminals 24 and 26. Although trigger conductor loops 20 are shown in FIG. 4 as being helically wound around the outside of fuse support structure 10, other winding locations and configurations may also be employed, as long as they result in the desired inductive coupling between the trigger conductor and the fuse conductor.

As also illustrated by FIG. 4, in accordance with another embodiment of the present invention, a trigger circuit for a chemically augmented fuse, of the type in which current flow through the fuse conductor produces a magnetic field, includes trigger conductor 18 shown in FIG. 4 and described above, and may further comprise trigger device 22 electrically connected to trigger conductor 18. Trigger conductor 18 may be formed entirely of exothermic material and disposed adjacent to the fuse conductor, in the conventional manner described above, so that current flow through conductor 18 in excess of a predetermined level causes the exothermic reaction which melts the fuse conductor. Alternatively, trigger conductor 18 may be formed of non-exothermic material, with one or more exothermic conductors being disposed adjacent the fuse conductor, and with the exothermic conductors being electrically connected in series with trigger conductor 18 between terminals 24 and 26, in a conventional manner as also described above. As illustrated in FIG. 4, the trigger circuit may further comprise trigger device 22.

Trigger device 22 is responsive to current flow through trigger conductor 18, and initiates the chemically augmented operation of the fuse when the current level exceeds a threshold value.

In the embodiment shown in FIG. 4, trigger device 22 is electrically connected in series with trigger conductor 18 and the exothermic reaction is initiated when the current through device 22 exceeds a predetermined level. In an alternative embodiment not shown in FIG. 4, trigger device 22 may comprise the conventional current sensing means described above. As an example, and not by way of limitation, trigger device 22 may comprise a current sensor of the type described in the above-referenced U.S. Pat. No. 3,958,206. As shown in FIG. 4, trigger device 22 is conveniently located inside of cylindrical support structure 10. However, other locations may also be employed, as long as trigger device 22 is electrically connected to trigger conductor 18 between terminals 24 and 26, and as long as excessive current flow through trigger conductor 18 results in initiation of the chemically augmented operation of the fuse.

In accordance with yet another embodiment of the present invention, a chemically augmented fuse having an inductively compensated trigger circuit comprises a non-magnetic fuse support structure and at least one fuse conductor wound around the support structure so that current flow through the fuse conductor generates a magnetic field, as illustrated by fuse support structure 10 and fuse conductor windings 12 shown in FIG. 1. Electrically connected in parallel with the fuse conductor is a trigger conductor containing at least one loop of electrically conductive material inductively coupled to the magnetic field of the fuse, so that the inductance of the trigger conductor is increased by the inductive coupling, as illustrated in FIG. 4 by trigger conductor 18 having trigger conductor loops 20 wound around fuse support structure 10.

The trigger conductor is connected to one or more conductors formed of exothermic material, with the exothermic conductors being disposed adjacent the fuse conductor so that a chemical reaction in the exothermic material causes melting of the fuse conductor at a number of locations along its length. The trigger conductor and the exothermic conductor are electrically connected so that current flow in the trigger conductor in excess of a predetermined level causes the exothermic reaction. The trigger conductor and exothermic conductor may be formed as separate conductors, or as a single structure, such as, for example, a conductor formed entirely of exothermic material.

In an alternative embodiment, a conventional trigger device which is responsive to current flow through the trigger conductor is electrically connected to the trigger conductor for initiating the chemically augmented operation of the fuse, as illustrated in FIG. 4 by trigger device 22 electrically connected to trigger conductor 18. Responsive to the initiating action of the trigger device is a means for chemically augmenting the separation of the fuse conductor into more than one segment during current interruption, such as, for example, a heat generating chemical reaction that melts the fuse conductor. In the embodiment illustrated by FIGS. 1 and 4, fuse support structure 10 is cylindrically shaped, and fuse conductor windings 12 and trigger conductor loops 20 are both helically wound around the outside of fuse support structure 10. However, other shapes and winding configurations may also be used. For example, either or both of fuse conductor windings 12 and trigger conductor loops 20 may be wound around the inside of fuse support structure 10. For applications in which fuse conductor windings 12 and trigger conductor loops 20 do not include an electrically insulating covering, fuse support structure 10 may comprise an electrically insulating material, in order to electrically isolate the windings from one another. In a particularly useful embodiment, fuse support structure 10 comprises a cylindrically shaped mesh of mica material.

The foregoing describes a trigger conductor for use in chemically augmented fuses that results in a constantly proportional division of current between the trigger circuit and the fuse conductor. The present invention provides a trigger circuit that employs mutual inductance between the fuse conductor and the trigger conductor to increase the inductance of the trigger circuit. The instant invention also provides a chemically augmented fuse having an inductively compensated trigger circuit that initiates the chemical augmentation of the fuse only in response to a high current level, and not in response to a high rate of rise of current.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A chemically augmented fuse comprising:

a trigger conductor;

exothermic material disposed adjacent to said trigger conductor, with said material being responsive to current flow in said trigger conductor so that a chemical reaction is initiated in said material in response to a predetermined level of current in said trigger conductor; and a fuse conductor disposed adjacent to said exothermic material, said trigger conductor comprising at least one loop of electrically conductive material disposed so as to be inductively coupled to the magnetic field generated by current flow through said fuse conductor, so that the effective inductance of said trigger conductor is increased by said inductive coupling.

2. An inductively compensated trigger circuit for a chemically augmented fuse of the type in which current flow through a fuse conductor produces a magnetic field, said trigger circuit comprising:

a trigger conductor electrically connected in parallel with said fuse conductor, said trigger conductor containing at least one loop of electrically conductive material disposed so as to be inductively coupled to the magnetic field generated by current flow through said fuse conductor, so that the effective inductance of said trigger conductor is increased by said inductive coupling, and an exothermic material disposed at least adjacent to said fuse conductor, with said material being responsive to current flow in said trigger conductor so that a chemical reaction is initiated in said material in response to a predetermined level of current in said trigger conductor.

3. The trigger circuit of claim 2 wherein said loop of said trigger conductor comprises a helically wound wire.

4. A chemically augmented fuse having an inductively compensated trigger circuit, said fuse comprising:

a non-magnetic fuse support structure;

at least one fuse conductor wound around said support structure, said fuse conductor being wound so that current flow therethrough generates a magnetic field;

a trigger conductor electrically connected in parallel with said fuse conductor, said trigger conductor containing at least one loop of electrically conductive material disposed so as to be inductively coupled to said magnetic field, so that the effective inductance of said trigger conductor is increased by said inductive coupling;

an exothermic material disposed at least adjacent to said fuse conductor, with said material being responsive to current flow in said trigger conductor so that a chemical reaction is initiated in said material in response to a predetermined level of current in said trigger conductor.

5. The fuse of claim 4 wherein said fuse support structure is cylindrically shaped.

6. The fuse of claim 4 wherein said fuse support structure comprises an electrically insulating material.

7. The fuse of claim 4 wherein said fuse support structure comprises a cylindrically shaped mesh of mica material.

8. The fuse of claim 5 wherein said fuse conductor is helically wound around the outside of said fuse support structure.

9. The fuse of claim 5 wherein said loop of said trigger conductor is helically wound around the outside of said fuse support structure.

10. The trigger circuit of claim 2 wherein said trigger conductor comprises exothermic material, and wherein at least a portion of said trigger conductor is disposed adjacent to said fuse conductor.

11. The trigger circuit of claim 2 further comprising a trigger device linking said trigger conductor and said exothermic material, said trigger device being responsive to current flow in said trigger conductor so that a chemical reaction is initiated in said exothermic material in response to a predetermined level of current in said trigger conductor.

12. The fuse of claim 4 wherein said trigger conductor comprises exothermic material, and wherein at least a portion of said trigger conductor is disposed adjacent to said fuse conductor.

13. The fuse of claim 4 further comprising a trigger device linking said trigger conductor and said exothermic material, said trigger device being responsive to current flow in said trigger conductor so that a chemical reaction is initiated in said exothermic material in response to a predetermined level of current in said trigger conductor.

* * * * *